US007386942B2

(12) United States Patent
Seigel

(10) Patent No.: US 7,386,942 B2
(45) Date of Patent: Jun. 17, 2008

(54) METHOD AND APPARATUS FOR MAPPING THE TRAJECTORY IN THE SUBSURFACE OF A BOREHOLE

(75) Inventor: Harold O. Seigel, Toronto (CA)

(73) Assignee: Scintrex Limited, Concord, Ontario (CA)

( * ) Notice: Subject to any disclaimer, the term of this patent is extended or adjusted under 35 U.S.C. 154(b) by 0 days.

(21) Appl. No.: 11/242,902

(22) Filed: Oct. 5, 2005

(65) Prior Publication Data

US 2006/0075645 A1 Apr. 13, 2006

(30) Foreign Application Priority Data

Oct. 7, 2004 (CA) ..... 2484104

(51) Int. Cl.
*E21B 47/022* (2006.01)

(52) U.S. Cl. ..... 33/313; 33/302; 33/304; 33/310; 175/45

(58) Field of Classification Search ..... 33/313, 33/301–304, 308–312; 175/45; 324/247, 324/253; 73/152.03
See application file for complete search history.

(56) References Cited

U.S. PATENT DOCUMENTS

| | | | | |
|---|---|---|---|---|
| 2,282,431 | A * | 5/1942 | Smith et al. | 166/255.3 |
| 3,587,175 | A * | 6/1971 | Armistead | 33/303 |
| 4,071,959 | A * | 2/1978 | Russell et al. | 33/312 |
| 5,172,480 | A * | 12/1992 | Labuc et al. | 33/304 |
| 5,435,069 | A * | 7/1995 | Nicholson | 33/304 |
| 5,960,370 | A * | 9/1999 | Towle et al. | 702/7 |
| 6,631,563 | B2 * | 10/2003 | Brosnahan et al. | 33/313 |
| 6,883,240 | B2 * | 4/2005 | Russell et al. | 33/313 |

* cited by examiner

*Primary Examiner*—G. Bradley Bennett
*Assistant Examiner*—Amy Cohen Johnson
(74) *Attorney, Agent, or Firm*—Sim & McBurney

(57) ABSTRACT

An apparatus for determining the orientation of a borehole at a point along the borehole, includes a tiltmeter for measuring the inclination of the borehole relative to the vertical, a vector magnetic sensor for measuring the amplitude of the component of the Earth's magnetic field along the axis of the borehole, and means for computing the orientation of the tubular sonde from the measurements of inclination and amplitude of the component of the Earth's magnetic field aligned with axis of the sonde.

13 Claims, 1 Drawing Sheet

METHOD AND APPARATUS FOR MAPPING THE TRAJECTORY IN THE SUBSURFACE OF A BOREHOLE

FIELD OF THE INVENTION

The present invention relates to mapping of the trajectory of a borehole and in particular to a method and apparatus for determining the orientation of a borehole at a point along the borehole.

BACKGROUND OF THE INVENTION

Small diameter boreholes, such as are commonly employed in mining programs, are subject to unpredictable wanderings along their length. For strategic and economic reasons, it is often vital to determine their true trajectories in the subsurface. Only in this way is it possible to obtain a valid three-dimensional picture of the subsurface geology, and, in particular, the true parameters of any mineral deposit whose economic potential is being evaluated.

Various approaches have been made to date to provide the means for determining borehole trajectories. These approaches include, for example, the following: gyroscopes, bending of light in a long tube, tiltmeter and compass and combined tiltmeter and three component magnetometer devices.

Gyroscope (either spinning masses or interferometric) devices measure (and integrate) the rate of deviation of two orthogonal gyros in a sonde to obtain the orientation of the sonde at any point in the borehole. Typical examples of such a device include the BGO-1 gyro orientation probe manufactured by the IFG Corporation, Brampton, Ontario; the RGS-OR rate gyro manufactured by Gyrodata, Houston Tex.; or the MT9 sensor manufactured by Xsens, Enschede, The Netherlands.

With respect to bending of a long tube, these devices typically use a collimated light beam, projected from a source at one end of a long, flexible tube and a target at the other end. The deviation of the incident light beam from the centre of the target (up-down and left-right) is measured and recorded, to determine the local curvature of the borehole in the vertical and horizontal planes. These curvatures are integrated, to determine the orientation of the borehole at any point. An example of this type of orientor is the Fotobor, manufactured by Reflex Instruments Limited, Sweden.

With respect to tiltmeter and compass devices, these devices feature a mechanical tiltmeter and a mechanical compass in a sonde. The status of both of these mechanical devices may be photographed at points down the borehole, using a miniature camera in the sonde. In a simpler (single shot) version, the two devices are clamped after an elapsed time, at one station. The Pajari instrument, manufactured by Pajari Instruments, Inc., Orillia, Ontario, is an example of this latter type of device.

The combined tiltmeter and three component magnetometer device employs a three component magnetometer and dual axes tiltmeters in a sonde to derive the borehole orientation. The BVM-01 vector magnetometer borehole probe manufactured by IFG Corporation, is an example of such a device. The BVM-01 device, however, requires complex instrumentation. Firstly, the BVM-01 device requires the use of two tiltmeters, one to measure the inclination of the sonde relative to the vertical and the other to measure the angle of rotation of the long axis of the sonde relative to the vertical. Secondly, the BVM-01 device requires the use of three magnetic sensors, measuring three mutually orthogonal components of the Earth's magnetic field.

All of the above devices suffer from one or more limitations, such as high capital cost, cumulative errors, drifts, instrument complexity or inefficiency in operation. It is therefore an object of the present invention to provide a novel method and apparatus for determining the orientation of a borehole at a point along the borehole, which is simpler in instrumentation and lower in cost than the above approaches.

SUMMARY OF THE INVENTION

Accordingly, in one aspect of the present invention, there is provided a method of determining the orientation of a borehole at a point along the borehole. The method includes measuring the inclination of the borehole relative to the vertical at the point, measuring the amplitude of the Earth's magnetic field component that is co-axial with the borehole at the point, and computing the orientation of the borehole at the point from the two measurements.

In one embodiment, the measurements are made at measurement points at regularly spaced distances along the length of the borehole. The increment in Cartesion coordinates between successive ones of the measurement points is computed from the measurements. The trajectory of the borehole is determined by the summation of successive increments in the Cartesion coordinates of the borehole from successive ones of the measurement points along the length of the borehole.

According to another aspect of the present invention, there is provided an apparatus for determining the orientation of a borehole at a point along the length of the borehole. The apparatus includes a substantially tubular sonde having an axis and a diameter suitable for insertion into the borehole, a tiltmeter mounted in the sonde for measuring the inclination of the axis of the sonde relative to vertical, a vector magnetic sensor mounted in the sonde for measuring the amplitude of the component of the Earth's magnetic field aligned with the axis of the sonde, and means for computing the orientation of the tubular sonde from the measurements of inclination and amplitude of the component of the Earth's magnetic field aligned with the axis of the sonde.

In one embodiment, the apparatus further includes means for computing increments in Cartesian coordinates between successive measurement points along the borehole, from the computed orientation. Means for computing the trajectory of the borehole by summing the increments in Cartesian coordinates between successive measurements points along the borehole is also provided. The tiltmeter may be a calibrated self-leveling mechanism of a borehole gravimeter and the vector magnetic sensor may be based on fluxgate principle.

According to yet another aspect of the present invention there is provided a method of mapping the trajectory of a borehole. The method includes at different points along the length of the borehole, measuring the inclination of the borehole relative to the vertical at the point; measuring the amplitude of the Earth's magnetic field component that is co-axial with the borehole at the point; computing the orientation of the borehole at the point from the two measurements; and mapping the trajectory of the borehole using the computed orientations for the different points.

As will be appreciated, similar to the BVM-01 vector magnetometer borehole probe, the subject method and apparatus utilize a combination of tiltmeter and vector magnetic component measurements to determine the orientation of a borehole. Advantageously, the subject method and apparatus require only a single component tiltmeter and a single component magnetic field sensor to determine the same information about the orientation of the borehole as is determined using the prior art BVM-01 vector magnetometer borehole probe. It is clear that the subject method and apparatus provide a simpler and lower cost approach to determining borehole orientation.

BRIEF DESCRIPTION OF THE DRAWINGS

An embodiment will now be described more fully with reference to the accompanying drawings in which.

DETAILED DESCRIPTION OF THE PREFERRED EMBODIMENTS

Figure 1:
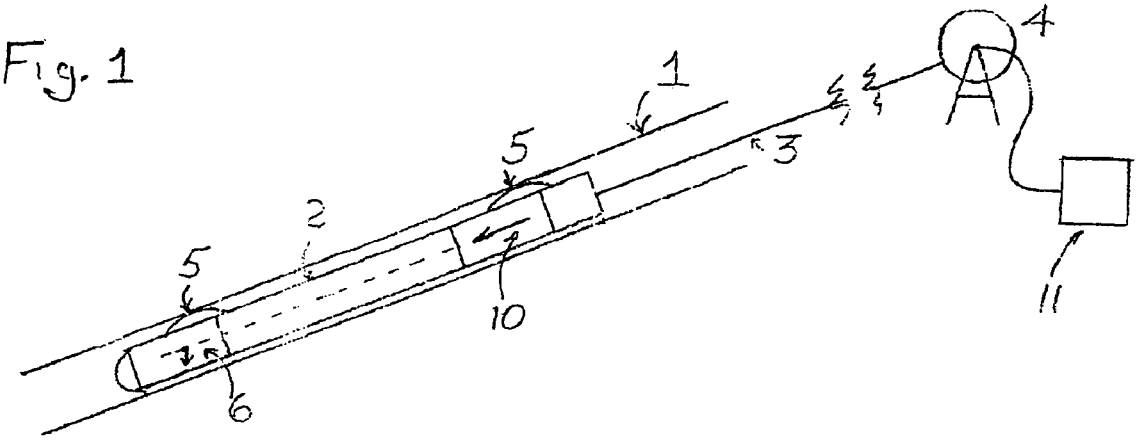
FIG. 1 is a schematic diagram of one embodiment of an apparatus for determining the orientation of a borehole at a point along the borehole.
Figure 2:
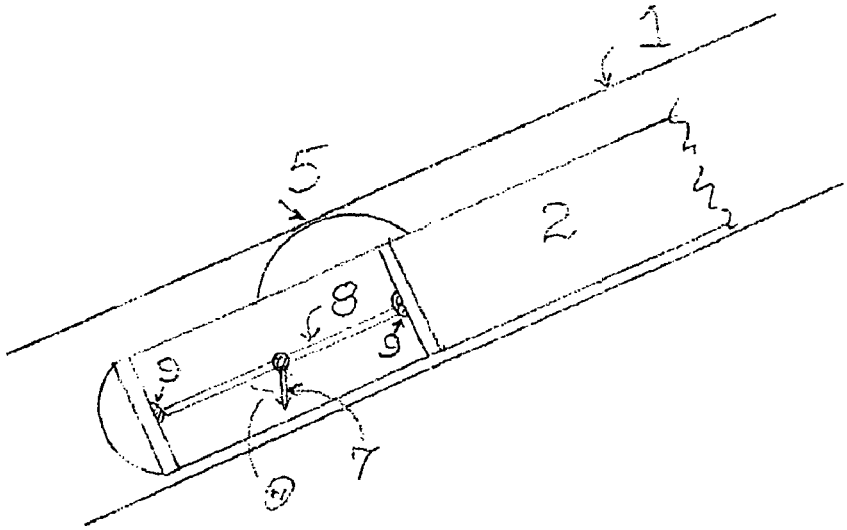
FIG. 2 is an enlarged sectional view of a portion of the apparatus of FIG. 1.

In FIGS. 1 and 2, item 1 is a borehole in which a sonde 2 has been lowered by means of a cable 3 wound on a winch 4. The sonde 2 is pressed firmly against one side of the borehole by longitudinally spaced springs 5. The sonde 2 contains two devices, namely a tiltmeter 6, whereby the inclination of the sonde 2 (and therefore of the borehole 1) relative to the vertical is measured. There are several suitable types of tiltmeters. In the present embodiment as shown in FIGS. 1 and 2, the tiltmeter 6 is based on a pendulum 7, mounted in a shaft 8, which is free to rotate with ball-bearings 9 within the sonde 2, so that the pendulum weighted side lies on the vertical plane containing the axis of the borehole 1. In this fashion, the pendulum 7 is constrained to rotate within this vertical plane, and thus accurately measures the angle of dip θ of the axis of the sonde 2 (and the borehole 1), relative to the vertical. The tiltmeter 6 is so designed as to provide an electrical output from which the dip angle θ is determined.

Item 10 is a single component magnetic sensor whose sensitive axis is aligned along the axis of the sonde 2. In the present embodiment, the magnetic sensor 10 is a fluxgate device, such as the Mag-01 MS single axis magnetic field sensor, manufactured by Bartington Instruments, Limited, Oxford, England. The magnetic sensor 10 provides an electrical output that is directly proportional to the amplitude of the Earth's magnetic field component, Ha, along the axis of the borehole at the point of measurement. Item 11 is an electronic chassis that receives and records the measurements from the tiltmeter 6 and the magnetic sensor 10, as well as the position of the measurement points from a counter on the cable winch 4.

The measurement of the two quantities, θ and Ha, is used to uniquely determine the orientation of the borehole at the point of measurement.

To start, the parameters of the normal, i.e. non-anomalous, Earth's magnetic field (vector H) at the collar of the borehole, in particular its scalar amplitude H and its direction cosines ($l_1$, $m_1$, $n_1$) relative to three orthogonal axes X, Y, and Z, are known (or determined). Taking the Y axis to be magnetic north, then $l_1=0$. The X axis is magnetic East and Z is the vertical axis. The direction cosines of the unit vector i, along the axis of the borehole at the point of measurement are designated to be l, m, and n, relative to these same coordinate axes. The direction cosines l, m, and n, are uniquely determined from measurements of θ and Ha.

Ha=H-i in vector notation, and can be expressed as:

$$=H(ll_1+mm_1+nn_1)=H(mm_1+nn_1), \quad (1)$$

since $l_1=0$

From the measurement of the tiltmeter output, $$n=\cos\theta \quad (2)$$

is known.

Thus, from equation (1):

$$m=(Ha/H-nn_1)/m_1 \quad (3)$$

is found. All the quantities on the right in this equation are either known or have been measured. Thus l is determined.

In other terminology, where ϕ s the "inclination" of the magnetic field, measured from the horizontal, rather than from the vertical, $n_1$ may be expressed as sin ϕ and $m_1$ as cos ϕ

The identity $$l^2+m^2+n^2=1 \quad (4)$$

is used to determine l, as follows:

$$l=\{1-n^2-m^2\}^{1/2} \quad (5)$$

Since n and m have been determined, l is now also determined

By making measurements of θ and Ha at a series of regularly spaced stations (points) (say at equal distances d) down the length of the borehole, the trajectory of the borehole in the subsurface is determined. The x, y, z coordinates of any point in the borehole, relative to the magnetic field coordinate system selected above, are then calculated by summing as follows:

$$x=x_0+d\ \Sigma_i l_i \quad (6)$$

$$y=y_0+d\ \Sigma_i m_i \quad (7)$$

$$z=z_0+d\ \Sigma_i n_i \quad (8)$$

where the subscript $_0$ denotes the coordinates of the collar of the borehole and the subscript $_i$ denotes the $i^{th}$ station (point) at successive distances d, measured along the borehole from the top of the borehole.

If it is found that the orientation of the borehole is changing rapidly between two successive measurement stations, then it may be more accurate to use the mean value of l, m, and n for these two stations, in equations 6, 7 and 8, above.

The subject apparatus and method of determining the orientation of a borehole is preferably applied in boreholes that do not have steel casing, and in geological formations that are relatively low in magnetic minerals, such as magnetite and pyrrhotite. Where large concentrations of such magnetic materials are locally present, the magnetic field may be seriously distorted, giving rise to erroneous estimates of l, and m. Nevertheless, even in such circumstances the trajectory of the borehole may be adequately established by means of measurements made in magnetically undisturbed sections of the borehole.

Although a specific embodiment has been described and shown in FIGS. 1 and 2, those of skill in the art will appreciate that variations are possible. For example, alternative tiltmeters may be employed. The leveling mechanism of the self-leveling borehole gravimeter may be calibrated to accurately indicate the inclination of the long axis of the sonde relative to the vertical. The component magnetic field sensor may also be a Hall Effect device or even a Squid (superconducting) sensor.

Other modifications and variations may occur to those skilled in the art. All such modifications and variations are believed to be within the sphere and scope of the present invention as defined by the appended claims.

What is claimed is:

1. A method of determining the orientation of a borehole at a point along the borehole, comprising:

measuring the inclination of the borehole relative to the vertical at said point;

measuring the amplitude of the Earth's magnetic field component that is co-axial with the borehole at said point using a single magnetic sensor generally oriented along the axis of the borehole; and computing the orientation of the borehole at said point using said inclination and magnetic field component amplitude measurements.

2. The method according to claim 1 wherein said inclination and magnetic field component amplitude measurements are made at measurement points at regularly spaced distances along the length of the borehole.

3. The method according to claim 2, further comprising computing the increment in Cartesian coordinates between successive ones of the measurement points, from said inclination and magnetic field component amplitude measurements.

4. The method according to claim 3, further comprising determining the trajectory of the borehole by the summation of successive increments in the Cartesian coordinates of the borehole from successive ones of the measurement points along the length of the borehole.

5. An apparatus for determining the orientation of a borehole at a point along the length of the borehole, comprising:

a substantially tubular sonde having a longitudinal axis and a diameter suitable for insertion into the borehole;

a tiltmeter mounted in the sonde for measuring the inclination of the longitudinal axis of the sonde relative to vertical;

a single, vector magnetic sensor mounted in and generally oriented along the longitudinal axis of the sonde, said magnetic sensor including means for measuring the amplitude of the component of the Earth's magnetic field aligned with the longitudinal axis of the sonde; and means for computing the orientation of said tubular some from said measurements of inclination and amplitude of the component of the Barth's magnetic field aligned with the longitudinal axis of the sonde.

6. The apparatus according to claim 5, further comprising means for computing increments in Cartesian coordinates between successive measurement points along the borehole, from the computed orientation.

7. The apparatus according to claim 6, further comprising means for computing the trajectory of said borehole by summing the increments in Cartesian coordinates between successive measurement points along said borehole.

8. The apparatus according to claim 5, wherein said tiltmeter is a calibrated self-leveling mechanism of a borehole gravimeter.

9. The apparatus according to claim 5, wherein said vector magnetic sensor is based on fluxgate principle.

10. A method of mapping the trajectory of a borehole comprising:

at different points along the length of said borehole, measuring the inclination of the borehole relative to the vertical at said point;

measuring the amplitude of the Earth's magnetic field component that is co-axial with the borehole at said point using a single magnetic sensor generally oriented along the axis of the borehole; and computing the orientation of the borehole at said point from said inclination and magnetic field component amplitude measurements; and mapping the trajectory of said borehole using said computed orientations for said different points.

11. The method according to claim 10 wherein said different points are generally equally spaced along the length of said borehole.

12. The method according to claim 11, wherein said mapping comprises computing the increment in Cartesian coordinates between successive ones of the measurement points, from said inclination and magnetic field component amplitude measurements.

13. The method according to claim 12, wherein said trajectory is mapped by the summation of successive increments in the Cartesian coordinates of the borehole from successive ones of the measurement points along the length of the borehole.

* * * * *